US005672455A

United States Patent [19]

Yanagida et al.

[11] Patent Number: 5,672,455

[45] Date of Patent: Sep. 30, 1997

[54] CARRIER FOR ELECTROSTATIC LATENT-IMAGE DEVELOPER, ELECTROSTATIC LATENT-IMAGE DEVELOPER AND IMAGE FORMING PROCESS

[75] Inventors: Kazuhiko Yanagida; Susumu Yoshino; Takashi Imai; Koichi Takahashi; Suk Kim, all of Minami-ashigara, Japan

[73] Assignee: Fuji Xerox Co., Ltd., Tokyo, Japan

[21] Appl. No.: 768,441

[22] Filed: Dec. 18, 1996

[30] Foreign Application Priority Data

Dec. 25, 1995 [JP] Japan ..... 7-336615

[51] Int. Cl.[6] ..... G03G 9/113; G03G 13/22

[52] U.S. Cl. ..... 430/108; 430/120

[58] Field of Search ..... 430/108, 120

[56] References Cited

U.S. PATENT DOCUMENTS

| | | | |
|---|---|---|---|
| 4,810,611 | 3/1989 | Ziolo et al. | 430/108 |
| 4,912,005 | 3/1990 | Goodman et al. | 430/108 |
| 5,093,201 | 3/1992 | Ohtani et al. | 430/108 |
| 5,424,160 | 6/1995 | Smith et al. | 430/108 |
| 5,496,675 | 3/1996 | Van Dusen et al. | 430/108 |
| 5,516,618 | 5/1996 | Cunningha et al. | 430/108 |

FOREIGN PATENT DOCUMENTS

A-4-188159 7/1992 Japan .

*Primary Examiner*—Roland Martin
*Attorney, Agent, or Firm*—Oliff & Berridge

[57] ABSTRACT

A carrier for an electrostatic latent-image developer, comprising a core material having thereon a coating layer comprising a resin and fine electroconductive particles, the resin having a work function of 4.5 eV or lower. An electrostatic latent-image developer comprising the carrier and a toner and an image forming process are also disclosed. The carrier is capable of maintaining a high build-up speed of electrification and a proper electrification level even when a charge control agent is omitted or used in a slight amount or when the addition amount of an additive such as silica and titanium oxide is reduced so as to prevent carrier fouling with a charge control agent or an external additive and to inhibit a decrease in developer life.

14 Claims, 3 Drawing Sheets

CARRIER FOR ELECTROSTATIC LATENT-IMAGE DEVELOPER, ELECTROSTATIC LATENT-IMAGE DEVELOPER AND IMAGE FORMING PROCESS

FIELD OF THE INVENTION

The present invention relates to a carrier for an electrostatic latent-image developer used for visualizing an electrostatic latent image in electrophotography, electrostatic recording, electrostatic printing, or the like. The present invention further relates to an electrostatic latent-image developer and an image process using the developer.

BACKGROUND OF THE INVENTION

The Carlson method has been generally used for image formation with a copier, laser beam printer, or the like. In the conventional process for image formation, an electrostatic latent image formed on a photoreceptor by an optical means is developed in a development step, subsequently transferred to a recording medium such as recording paper, and then fixed in a fixing step to the recording medium generally by heat and pressure. In order for the photoreceptor to be repeatedly used, it is equipped with a cleaning device for removing the residual toner remaining on the photoreceptor after transfer.

The techniques for the development of an electrostatic latent image include one-component development using a toner alone and two-component development using a toner and a carrier. Two-component developers for use in the two-component development technique have advantages in that since the toner is frictionally charged by stirring the toner together with the carrier, the amount of toner charges generated by friction and the migration of a toner component to the carrier can be controlled in considerably wide ranges by selecting properties of the carrier, whereby image quality and reliability can be heightened.

When a two-component developer is used, the developer is replenished with a fresh toner as toner consumption proceeds. This fresh toner supplied is charged mainly by mechanical stirring, before transported to the developing part. The speed of this charging of the supplied toner by the mechanical stirring of the carrier/toner mixture (hereinafter referred to as "the build-up speed of electrification") is one of the important properties of a developer. If a toner added to a developer from a toner feeder does not gain a given amount of charges before being transported to the developing part, that causes internal machine fouling with toner and image failures such as fogging. In an extreme case, there has been a problem that toner particles fly out of the machine to foul the office environment. Not only the build-up speed of electrification, of course, varies depending on the rate and strength of mechanical stirring in the developing device, but also it is known that the speed is considerably influenced also by the compositions of the carrier and the toner.

Obtaining a developer having a high build-up speed of electrification is important as described above. Known prior art methods therefor include a technique of adding a toner charge control agent and a technique of adding an external additive, for example, electrically insulating particles of silica or alumina which has been surface-treated with a coupling agent or the like, and fine semiconducting particles of titanium oxide, to the surface of a toner. The larger the addition amount of these additives, the more the build-up speed of electrification tends to increase.

However, the technique of adding a charge control agent is disadvantageous in that since the adhesion between the charge control agent present on the toner surface and the toner binder resin is weak, part of the charge control agent migrates to the carrier surface during copying operations for producing many copies to thereby foul the carrier. As a result, there has been a problem that secondary troubles such as a decrease in toner charge amount arise to prevent the attainment of life prolongation of a developer.

The technique of adding an external additive such as silica also has a disadvantage that due to the presence of silica or other particles on the toner surface, part of the external additive migrates to the carrier surface during copying operations for producing many copies to thereby foul the carrier, which fouling arouses secondary troubles such as a decrease in toner charge amount and prevents the attainment of life prolongation of a developer. This tendency is considerable especially when the addition amount of the external additive is large.

Furthermore, another known technique for obtaining an elevated build-up speed of electrification is to use as a carrier-coating agent a resin obtained by grafting a vinyl polymer onto a nitrogen-containing vinyl polymer (see JP-A-4-188159; the term "JP-A" as used herein means an "unexamined published Japanese patent application"). This prior art technique has a disadvantage that since the resin tends to negatively charge a toner to a high degree, the amount of charges exceeds the upper limit of the charge amount range suitable for practical use unless a coating layer is formed in a considerably small thickness. Consequently, forming a thick coating layer for imparting durability to the coating layer is impossible, resulting in insufficient durability. Although the amount of charges can be reduced to a relatively small value by using the above resin in combination with a fluororesin, this is disadvantageous in that the rate of electrification becomes extremely low.

As described above, there are some techniques for heightening the build-up speed of electrification. However, there is no general guiding principle in investigations, and the only way to produce a toner having a heightened build-up speed of electrification has been to make intensive experiments to select suitable materials among a large number of materials.

The build-up speed of electrification depends on the speed and strength of mechanical stirring in the developing device; the higher the stirring speed and the higher the stirring strength, the higher the build-up speed of electrification. However, the mechanical conditions which heighten the build-up speed of electrification tend to accelerate carrier fouling with a toner component.

SUMMARY OF THE INVENTION

An object of the present invention is to provide a carrier for an electrostatic latent-image developer which carrier is capable of maintaining a high build-up speed of electrification and a proper electrification level even when a charge control agent is omitted or used in a slight amount or when the addition amount of an additive such as silica and titanium oxide is reduced so as to prevent carrier fouling with a charge control agent or an external additive and to inhibit a decrease in developer life. Another object of the present invention is to provide an electrostatic latent-image developer and a process for image formation using the developer.

The present inventors made extensive investigations on two-component developers in which the build-up speed of electrification after replenishment with toner is high. As a result, it has been found that the lower the work function of the carrier surface, the higher the build-up speed of electrification. In particular, the present inventors have found that a desired build-up speed of electrification can be ensured when a carrier coated with a resin having a work function of 4.5 eV or lower is used. The present invention has been completed based on this finding.

The carrier of the present invention for an electrostatic latent-image developer does not cause a toner to be charged in too large an amount even when the coating layer thereof is thick, because the coating layer contains electroconductive particles. In the present invention, the incorporation of electroconductive particles does not result in a decrease in electrification speed. The constitution of the present invention is described below.

(1) A carrier for an electrostatic latent-image developer, comprising a core material having thereon a coating layer comprising a resin and fine electroconductive particles, in which the resin has a work function of 4.5 eV or lower.

(2) The carrier for an electrostatic latent-image developer as described in (1) above, in which the resin comprises at least one member selected from the group consisting of poly(vinyl alcohol), poly(ethylene glycol), graft copolymers of diethylaminoethyl methacrylate and styrene-acrylic, and graft copolymers of diethylaminoethyl methacrylate and methyl methacrylate.

(3) The carrier for an electrostatic latent-image developer as described in (1) or (2) above, in which the coating layer of the carrier (i.e., the surface of the carrier) has a work function of 4.6 eV or lower.

(4) The carrier for an electrostatic latent-image developer as described in any one of (1) to (3) above, in which the fine electroconductive particles have a work function of from 4.6 to 5.2 eV.

(5) The carrier for an electrostatic latent-image developer as described in any one of (1) to (4) above, in which the fine electroconductive particles have a resistivity of $10^5$ Ωcm or lower.

(6) The carrier for an electrostatic latent-image developer as described in any one of (1) to (5) above, in which the coating layer contains the fine electroconductive particles in an amount of from 2 to 40% by volume based on the volume of the coating layer.

(7) The carrier for an electrostatic latent-image developer as described in any one of (1) to (6) above, in which the fine electroconductive particles have an average particle diameter of from 10 to 500 nm.

(8) The carrier for an electrostatic latent-image developer as described in any one of (1) to (7) above, in which the resin constituting the coating layer contains a fluororesin or a silicone resin.

(9) The carrier for an electrostatic latent-image developer as described in (8) above, in which the content of the fluororesin or the silicone resin in the resin constituting the coating layer is from 2 to 20% by weight based on the weight of the coating layer.

(10) The carrier for an electrostatic latent-image developer as described in any one of (1) to (9) above, which has a dynamic resistivity in a $10^4$ V/cm electric field of $10^9$ Ωcm or lower.

(11) An electrostatic latent-image developer which comprises the carrier for an electrostatic latent-image developer as described in any one of (1) to (10) above and a toner comprising a binder resin and a colorant.

(12) The electrostatic latent-image developer as described in (11) above, in which the binder resin of the toner comprises a styrene/acrylic resin, a polyester resin, or an epoxy resin.

(13) The electrostatic latent-image developer as described in (12) above, in which the toner contains silica and/or titania as an external additive.

(14) A process for image formation which comprises the steps of forming a latent image on a latent-image holder, developing the latent image with a developer, transferring the developed toner image to a receiving material, and fixing the toner image to the receiving material, the developer being the electrostatic latent-image developer as described in any one of (11) to (13) above.

DETAILED DESCRIPTION OF THE INVENTION

Figure 1:
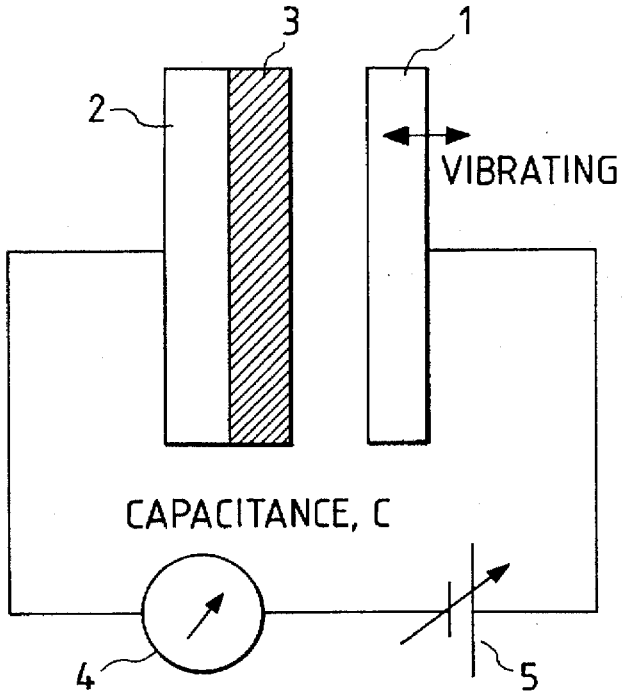
FIG. 1 is a view illustrating the concept of a contact potential difference meter based on the Kelvin method.

In the present invention, the work function of the coating layer of a carrier (i.e., the work function of the surface of a carrier) is determined as follows. The work function herein means the difference between the Fermi level and the vacuum level, and is determined based on the principle of contact potential difference by the Kelvin method using a change in vibrating capacitance. FIG. 1 is a view illustrating the concept of a contact potential difference meter based on the Kelvin method. This device comprises a reference electrode 1 made of gold-plated brass and a gold-plated brass substrate 2 on which a sample 3 is deposited. The reference electrode 1 and the sample 3 constitute a kind of capacitor, to which a contact potential difference generated between the sample 3 and the reference electrode 1 is applied. When the reference electrode 1 is vibrated, the capacitance of the capacitor fluctuates and a current flows through the circuit, which is measured with an ammeter 4. An external power source 5 is then used to apply a potential in such a direction as to compensate for the contact potential difference, and that potential of the external power source 5 which results in a current of zero is determined. This potential is the contact potential difference.

For correctly measuring the contact potential difference, it is important to keep the sample in sufficient electrical contact with the substrate. In the case of examining a coating material consisting of a resin alone or of a resin containing electroconductive particles, the sample was dissolved in a solvent and the solution was thinly applied to the substrate 2 to form a layer of the sample having a thickness of 0.5 to 1 μm and tightly adhering to the substrate 2. In the case of examining relatively large spherical material such as iron particles or ferrite carrier particles, an electroconductive adhesive comprising silver dispersed in a resin (e.g., Dotite D-550, manufactured by Fujikura Kasei Co., Ltd.) was applied to a substrate and the carrier particles were not embedded in the electroconductive adhesive but closely disposed thereon so as not to foul the carrier surface with the adhesive. Samples prepared as described above were tested. These samples were dried at 100° C. for 5 hours in a vacuum, subsequently allowed to stand for 2 hours in a conditioning room of 20°±2° C. and 50±5% RH, and then subjected to the measurement of contact potential difference in the conditioning room. The above-described procedures are essential for heightening the reproducibility of measurement and obtaining highly reliable data.

The obtained value of contact potential difference for each sample is the difference in work function between the sample and the reference electrode. The work function of the coating layer of the carrier is obtained by subtracting the contact potential difference from the work function of the reference electrode. In the case where the sample has a lower work function than the reference electrode, the contact potential difference is a positive value.

Figure 2:
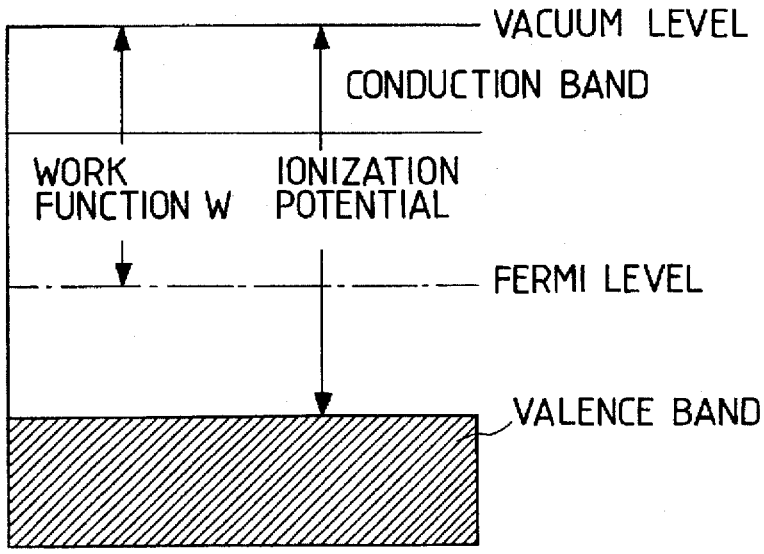
FIG. 2 is a view illustrating the relationship between work function and ionization potential in a semiconductor or insulator.

The work function of the reference electrode was determined with photoelectron spectrometer AC-1, manufactured by Riken Keiki Co., Ltd. The substances whose work functions can be determined with the above photoelectron spectrometer are limited to those having a metallic electronic state including the reference electrode (substances in which electrons occupy part of the conduction band). It should be noted that when the above spectrometer is used to analyze photoelectron emission of an insulator or semiconductor, the value determined by plotting a power of the yield of photoelectrons against the energy of incident light means ionization potential, or the threshold value of photoelectron emission, and is not the work function as used in the present invention. (see FIG. 2)

It is generally thought that charge exchange between a toner and a carrier by means of electrons as charge carriers occurs based on a difference in work function between the toner and the carrier when electrons move from the substance having a lower work function to the substance having a higher work function. In carriers which function to negatively charge toners, like the carrier of the present invention, electrons move from the carriers to the toners. Consequently, in the present invention, the carrier is a substance having a lower work function and the toner is a substance having a higher work function. General toners containing no external additives have a work function of from 4.7 to 4.8 eV. Assuming that an energy barrier is present between a toner and a carrier where charge exchange occurs, this means that charges are exchanged over the barrier. In the initial stage of electrification in which electrification has not saturated, the above energy barrier relates to the difference in work function between the toner and the carrier. It is presumed that the larger the difference in work function between a toner and a carrier, the lower the barrier present between the toner and the carrier.

It is generally thought that when a carrier coated with a material containing fine electroconductive particles is used in combination with a toner, the toner has a reduced electrification speed as a result of the contact thereof with fine electroconductive particles exposed on the coating layer surface. However, use of a resin having a work function of 4.5 eV or lower as the resin constituting the coating layer is effective in preventing the electrification speed from decreasing. It is thought that the electrification speed is governed mostly by the resin when the content by volume of fine electroconductive particles is within a given range.

Therefore, in the present invention, a resin having a work function of 4.5 eV or lower is used in the coating layer of the carrier for an electrostatic latent-image developer, and fine electroconductive particles having a work function of from 4.6 to 5.2 eV are incorporated into the resin in an amount of 2 to 40% by volume based on the total volume of the resin and the fine electroconductive particles. As a result, it has become possible to heighten the build-up speed of electrification after toner replenishment and to maintain a proper electrification level. Resins having a work function of 4.0 eV or higher are preferred.

The resin for use in the carrier of the present invention, which has a work function of 4.5 eV or lower, may be at least one member selected from the group consisting of poly (vinyl alcohol), poly(ethylene glycol), graft copolymers of diethylaminoethyl methacrylate and styrene-acrylic, and graft copolymers of diethylaminoethyl methacrylate and methyl methacrylate. A copolymer of up to 10 wt % diethylaminoethyl methacrylate (based on the resin) and one or more other monomers is especially effective in facilitating the regulation of the work function thereof to a value within the above range. However, the resin for use in the present invention should not be construed as being limited to diethylaminoethyl methacrylate copolymers.

The resin for use in the carrier of the present invention may be a blend of any of the above-enumerated resins with one or more other resins. In the case of a combination with a fluororesin or silicone resin, the addition amount of the fluororesin or silicone resin should be regulated so that the work function of the whole resin blend does not exceed 4.5 eV.

A coating resin comprising a combination with a fluororesin or silicone resin can provide a carrier which has excellent antifouling properties and enables a high build-up speed of electrification. Since a fluororesin or silicone resin is apt to be exposed on the carrier surface even when used as a mixture with another resin, the above effects can be obtained even when the proportion of the fluororesin or silicone resin in all resins is reduced. Specifically, the proportion thereof is preferably from 2 to 20% by weight, more preferably from 4 to 10% by weight. If the proportion thereof is below 2% by weight, the effects described above cannot be achieved. If the proportion thereof exceeds 20% by weight, the build-up speed of electrification decreases considerably.

Examples of the fine electroconductive particles for use in the present invention include fine particles of metals such as gold, silver and copper; carbon black; fine particles of semiconducting oxides such as titanium oxide and zinc oxide; and particles obtained by covering the surface of fine particles of titanium oxide, zinc oxide, barium sulfate, aluminum borate, potassium titanate, or the like with tin oxide, carbon black, any of the above metals, or the like.

The work function of those fine electroconductive particles is preferably from 4.6 to 5.2 eV, more preferably from 4.6 to 5.0 eV. If the work function thereof is lower than 4.6 eV, producibility is impaired. Work functions thereof exceeding 5.2 eV are undesirable in that such high work functions result in a reduced carrier charge amount.

The average particle diameter of those fine electroconductive particles is preferably from 10 to 500 nm.

The amount of the fine electroconductive particles incorporated into the coating material in the carrier of the present invention is preferably from 2 to 40% by volume, more preferably from 5 to 20% by volume based on the total volume of the resin and the fine electroconductive particles.

The electrical resistance and charge amount of a developer can be varied by regulating the resistivity of the fine electroconductive particles employed in the carrier of the present invention. Specifically, fine electroconductive particles having a resistivity of $10^5$ Ωcm or lower are preferred. The lower limit of the resistivity thereof is preferably $10^{-2}$ Ωcm.

Figure 5:
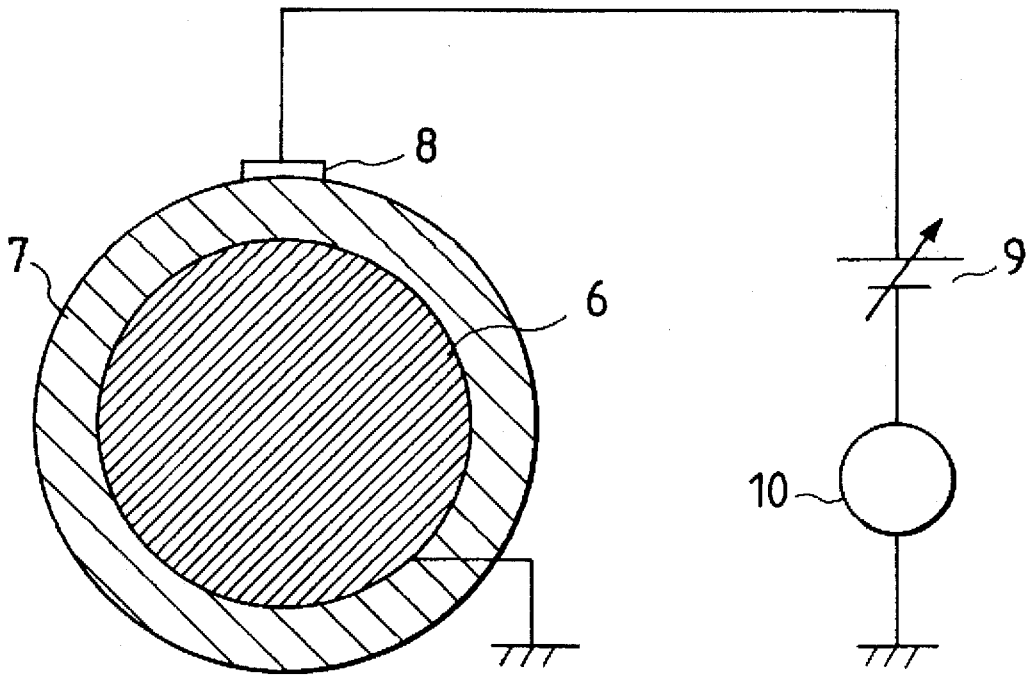
FIG. 5 is a view illustrating the concept of a device for measuring the dynamic resistivity of a carrier.

The dynamic resistivity of a carrier is measured with the apparatus shown in FIG. 5, as follows. The carrier 7 is supported on a developing roll 6, and the resistance between the developing roll 6 and a counter electrode 8 (connecting to a power source 9 and an ammeter 10) is measured while rotating the developing roll. This measurement was made under the conditions of a developing roll/counter electrode gap of 2.5 mm, a counter electrode width of 5 mm, a counter electrode length (in the direction of the developing roll length) of 60 mm, a developing roll diameter of 38 mm, and a rotational speed of the developing roll of 240 rpm while applying an electric field of 10,000 V/cm.

By incorporating the fine electroconductive particles into the coating layer of the carrier, the dynamic resistivity of the carrier can be varied. In particular, the incorporation of fine electroconductive particles having an electrical conductivity of 10 Ωcm or lower is effective in changing the dynamic resistivity of the carrier in a great degree. In the present invention, the dynamic resistivity of the carrier in a $10^4$ V/cm electric field is preferably $10^9$ Ωcm or lower, especially preferably from $10^7$ to $10^2$ Ωcm.

Known core materials may be used for the carrier of the present invention. Examples of useful carriers include iron powder carriers, ferrite carriers, surface-coated ferrite carriers and magnetic dispersion type carriers.

The core material of the present invention is coated with the above-described coating layer composition comprising a resin and fine electroconductive particles preferably in an amount of from 0.01 to 10% by weight based on the weight of the carrier.

The toner for use in the present invention comprises a binder resin and a colorant contained therein. Examples of useful binder resins include styrene resins, acrylic resins, styrene/acrylic resins, polyester resins, polyurethanes, epoxy resins, silicone resins and polyamides. Especially representative binder resins include polystyrene, styrene/alkyl acrylate copolymers, styrene/alkyl methacrylate copolymers, styrene/acrylonitrile copolymers, styrene/butadiene copolymers, styrene/maleic anhydride copolymers and polyester resins. However, the binder resin should not be construed as being limited to these examples.

Examples of the styrene resins include homopolymers and copolymers of styrene and derivatives thereof. Specific examples of such monomers include styrene, alkylstyrenes such as methylstyrene, dimethylstyrene, trimethylstyrene and ethylstyrene, and halogenated styrenes.

Examples of the acrylic resins include homopolymers and copolymers of acrylic acid, methacrylic acid, and derivatives of these acids, such as acrylic esters, methacrylic esters and acrylonitrile. Specific examples of such monomers include acrylic acid, methacrylic acid, methyl acrylate, ethyl acrylate, propyl acrylate, n-butyl acrylate, isopropyl acrylate, dodecyl acrylate, 2-ethylhexyl acrylate, n-octyl acrylate, phenyl acrylate, methyl methacrylate, ethyl methacrylate, propyl methacrylate, n-butyl methacrylate, isobutyl methacrylate, 2-ethylhexyl methacrylate, acrylonitrile, methacrylonitrile, and acrylamide.

Examples of the styrene/acrylic resins include methylene/acrylic ester copolymers and styrene/methacrylic ester copolymers. Such resins are obtained by copolymerizing monomers enumerated above.

Copolymers of the monomers enumerated above with other vinyl monomers are also useful. Examples of such monomers include unsaturated monoolefins such as ethylene, propylene and isobutylene, vinyl chloride, vinyl bromide, and vinyl esters such as vinyl acetate and vinyl propionate. These monomers can be copolymerized, either alone or in combination of two or more thereof, with any of the above-described styrene monomers and/or acrylic monomers.

The polyester resins are synthesized from polyhydric alcohol ingredients and polycarboxylic acid ingredients.

Examples of useful polyhydric alcohol ingredients include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, poly(ethylene glycol), poly(propylene glycol), bisphenol A and hydrogenated bisphenol A.

Bisphenol A alcohols are especially preferred. Specific examples thereof include polyoxypropylene(6)-2,2-bis(4-hydroxyphenyl)propane, polyoxyethylene(2.2)-2,2-bis(4-hydroxyphenyl)propane and polyoxypropylene(2.0)-polyoxyethylene(2.0)-2,2-bis(4-hydroxyphenyl)propane. Examples of useful trihydric and higher alcohol ingredients include glycerol, sorbitol, 1,4-sorbitan and trimethylolpropane.

Examples of useful polycarboxylic acid ingredients include maleic acid, maleic anhydride, fumaric acid, phthalic acid, terephthalic acid, isophthalic acid, malonic acid, succinic acid, glutaric acid, n-octylsuccinic acid, n-dodecenylsuccinic acid, 1,2,4-benzenetricarboxylic acid, 1,2,4-cyclohexanetricarboxylic acid, 1,2,4-naphthalenetricarboxylic acid, 1,2,5-hexanetricarboxylic acid, 1,3-dicarboxy-2-methyl-2-carboxymethylpropane, tetra(carboxymethyl)methane, 1,2,7,8-octanetetracarboxylic acid, trimellitic acid, pyromellitic acid and lower alkyl esters of these acids.

Styrene/acrylic resins or polyester resins are preferably used in the present invention. Especially preferred are styrene/acrylic ester copolymers or styrene/methacrylic ester copolymers.

Examples of the colorant of the toner include carbon black, nigrosine, aniline blue, Calco Oil Blue, chrome yellow, ultramarine blue, Dupont Oil Red, quinoline yellow, methylene blue chloride, phthalocyanine blue, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, C.I. Pigment Blue 15:3, and mixtures thereof.

If necessary, known additives such as a fixing aid may be incorporated into the toner particles. External additives such as hydrophobic silica and titania may be added to the toner surface in an amount of 0.2 to 3 parts by weight, preferably 0.3 to 2 parts by weight, per 100 parts by weight of the toner.

The average particle diameter of the toner particles of the present invention is preferably about 30 μm or smaller, more preferably from 4 to 20 μm.

The developer of the present invention is preferably used in the toner concentrations of from 0.3 to 10% by weight.

The developer obtained according to the present invention can be charged quickly with an ordinary developing device for two-component developers which has at least a developing roll (developer carrier) and a member for regulating developer layer thickness, and in which the developing roll revolves in the same direction as the photoreceptor ("with mode") and the peripheral-speed ratio of the developing roll to the photoreceptor is in the range of from 1.9 to 3.8. However, the developer of the present invention can exhibit the above improved results even when stirred gently in a developing device in which that peripheral-speed ratio is below 1.9, and can also be advantageously used therein. Especially when that peripheral-speed ratio is in the range of from 0.7 to 1.8, the impaction of the toner or external additives on the carrier can be diminished and the developer can have a prolonged life.

The present invention is explained below by reference to Examples, but the invention should not be construed as being limited thereto.

EXAMPLE 1

Production of Carrier

To a 13 wt % toluene solution of a carrier-coating resin consisting of a copolymer of 5 parts by weight of diethylaminoethyl methacrylate, 85 parts by weight of methyl methacrylate, and 10 parts by weight of butyl acrylate was added Passtran Type IV 4300 (manufactured by Mitsui Mining & Smelting Co., Ltd.; $SnO_2$-coated $BaSO_4$ (specific gravity, 5.6) made to have a resistivity of $10^0$ Ωcm by regulating the coating amount) as fine electroconductive particles in an amount of 20 vol % based on the amount of the resin. The resulting mixture containing the solvent was treated with a 1-liter sand mill for 1 hour at a rotational speed of 1,468 rpm to disperse the particles. Thus, a coating solution was obtained.

To 100 parts by weight of ferrite particles having a particle diameter of about 50 μm was added 2 parts by weight of the coating solution in terms of resin amount. The ferrite particles were coated by kneading the mixture with a kneader to obtain a carrier. The coating layer thus obtained had a thickness of about 1 μm, and the carrier had a dynamic resistivity of $3\times10^7$ Ωcm. The work function of the surface of this carrier was measured with a contact potential difference meter, and was found to be 4.4 eV. The work function of the copolymer alone was 4.4 eV, and that of the fine electroconductive particles was 4.90 eV.

Production of Toner

A mixture of 100 parts by weight of a linear polyester resin (linear polyester obtained from terephthalic acid, bisphenol A ethylene oxide adduct and cyclohexanedimethanol; $T_g$, 62° C.; $M_n$, 4,000; $M_w$, 35,000; acid value, 12; hydroxyl value, 25) and 3 parts by weight of a magenta pigment (C.I. Pigment Red 57) was kneaded with an extruder, pulverized with a jet mill, and then classified with an air classifier to obtain magenta toner particles having a volume-average particle diameter ($d_{50}$) of 8 μm.

Measurement of Build-up speed of electrification

Figure 3:
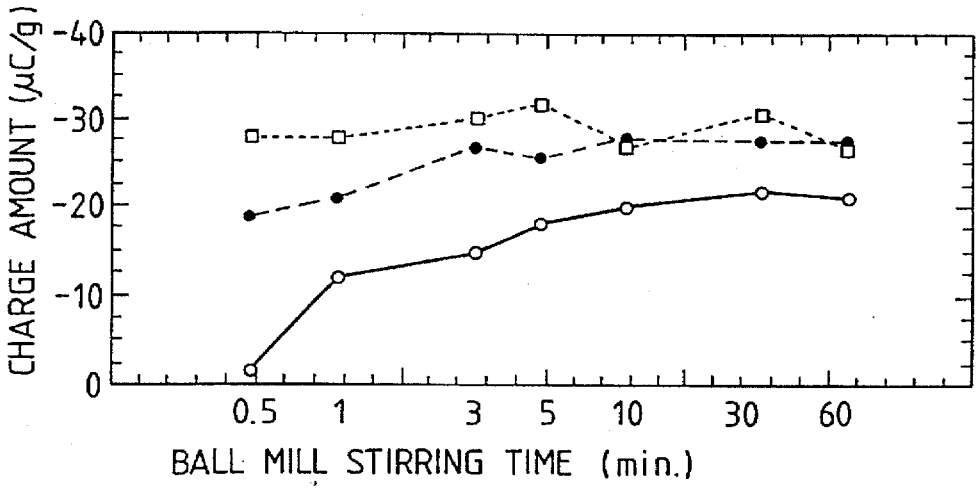
FIG. 3 is a graph showing the relationship between ball mill stirring time and charge amount. In the figure, ▽, ●, and ○ indicate plots of data for the developer of Example 1, that of Example 2, and a conventional developer, respectively.
Figure 4:
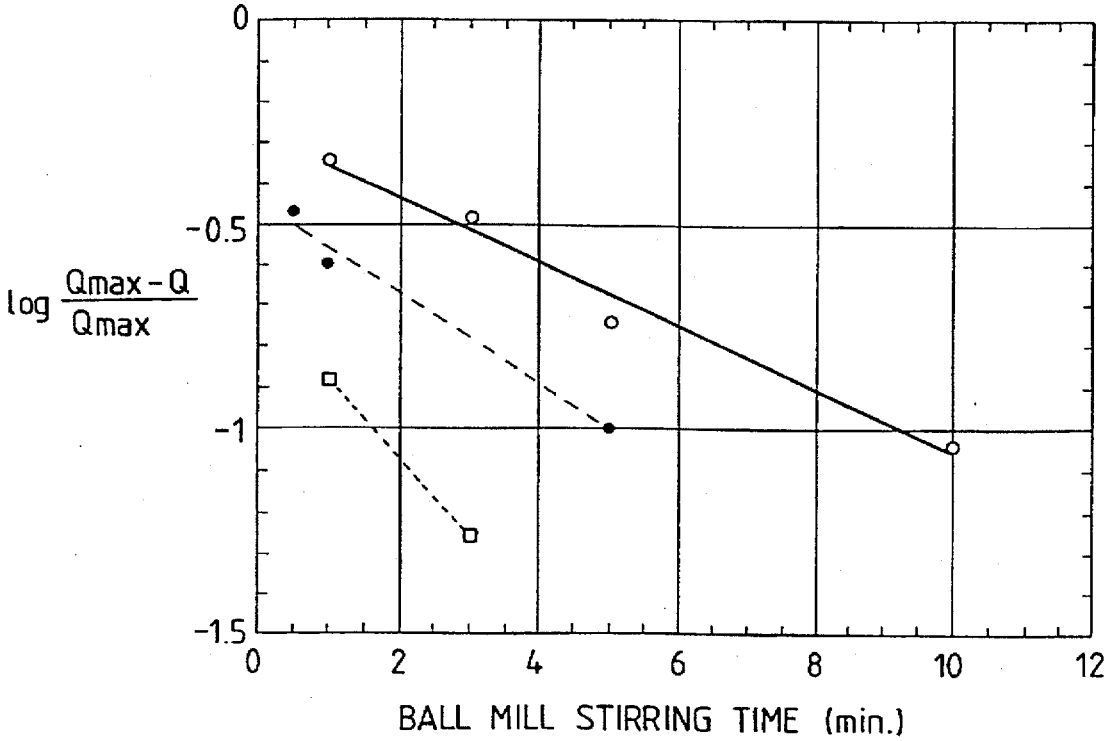
FIG. 4 is a graph for illustrating a way to determine the build-up speed of electrification. In the figure, ▽, ●, and ○ indicate plots of data for the developer of Example 1, that of Example 2, and a conventional developer, respectively.

A 37.5 g portion of the carrier was mixed with 3 g of the toner (corresponding to 8 parts by weight of the toner per 100 parts by weight of the carrier) by means of a ball mill made of glass (cylindrical vessel having an inner diameter of 6 cm and a height of 5 cm) rotating at 60 rpm to measure the build-up speed of electrification. The charge amount Q was plotted against the stirring time t as shown in FIG. 3. From the data obtained, the build-up speed of electrification k was determined as shown in FIG. 4 using the following equation (1), which is a model of build up of electrification. $Q_{max}$ is the maximum charge amount. In FIGS. 3 and 4, ▽, ●, and ○ indicate plots of data for the developer of Example 1, that of Example 2, and a conventional developer, respectively.

$$Q=Q_{max}[1-\exp(-kt)] \quad (1)$$

Equation (1) was changed as follows in order to determine k.

$$\log[(Q_{max}-Q)/Q_{max}]=-kt \quad (2)$$

The thus-determined values of the build-up speed of electrification k and maximum charge amount $Q_{max}$ are shown in Table 1. The amount of charges was determined through image analysis by charge spectrography (CSG).

EXAMPLE 2

To a 10 wt % solution of poly(vinyl alcohol) (degree of polymerization, 2,000) as a carrier-coating resin in a water/alcohol mixed solvent was added Passtran Type IV 4300A (manufactured by Mitsui Mining & Smelting Co., Ltd.; $SnO_2$-coated $BaSO_4$ having a specific gravity of 4.6 and made to have a resistivity of $10^5$ Ωcm by regulating the coating amount) as fine electroconductive particles in an amount of 20 vol % based on the amount of the resin. The resulting mixture containing the solvent was treated with a 1-liter sand mill for 1 hour at a rotational speed of 1,468 rpm to disperse the particles. Thus, a coating solution was obtained.

To 100 parts by weight of ferrite particles having a particle diameter of about 50 μm was added 2 parts by weight of the coating solution. The ferrite particles were coated by kneading the mixture with a kneader to obtain a carrier. The coating layer thus obtained had a thickness of about 1.2 μm, and the carrier had a dynamic resistivity of $8\times10^8$ Ωcm. The work function of the surface of this carrier was measured in the same manner as in Example 1, and was found to be 4.45 eV. The work function of the poly(vinyl alcohol) alone was 4.4 eV, and that of the fine electroconductive particles was 4.86 eV.

A hundred parts by weight of the carrier was mixed with 8 parts by weight of the toner produced in Example 1, by means of a ball mill to measure the build-up speed of electrification in the same manner as in Example 1. The results obtained are shown in Table 1 together with the maximum charge amount.

EXAMPLE 3

Production of Carrier

To a 13 wt % toluene solution of a carrier-coating resin consisting of a copolymer of 98 parts by weight of styrene and methyl methacrylate monomers (monomer ratio 20:80) and 2 parts by weight of diethylaminoethyl methacrylate was added Passtran Type IV 4410 (manufactured by Mitsui Mining & Smelting Co., Ltd.; $BASO_4$ coated with Sb-doped $SnO_2$; specific gravity, 4.8; resistivity, $10^1$ Ωcm) as fine electroconductive particles in an amount of 30 vol % based on the amount of the resin. The resulting mixture containing the solvent was treated with a 1-liter sand mill for 1 hour at a rotational speed of 1,468 rpm to disperse the particles. Thus, a coating solution was obtained.

To 100 parts by weight of ferrite particles having a particle diameter of about 80 μm was added 1 part by weight of the coating solution. The ferrite particles were coated by kneading the mixture with a kneader to obtain a carrier. The coating layer thus obtained had a thickness of about 0.5 μm, and the carrier had a dynamic resistivity of $6\times10^6$ Ωcm. The work function of the surface of this carrier was measured in the same manner as in Example 1, and was found to be 4.45 eV. The work function of the copolymer alone was 4.4 eV, and that of the fine electroconductive particles was 4.97 eV.

Production of Toner

A toner was produced as follows. A mixture of 92 parts by weight of a binder resin consisting of a styrene/butyl acrylate copolymer and 8 parts by weight of carbon black BPL (manufactured by Cabot Co., Ltd.) as a colorant was kneaded with an extruder, pulverized with a jet mill, and then classified with an air classifier to obtain black toner particles having a $d_{50}$ of 9.5 μm.

Measurement of Build-up Speed of Electrification

A 37.5 g portion of the carrier was mixed with 2.25 g of the toner (corresponding to 6 parts by weight of the toner per 100 parts by weight of the carrier) in the same manner as in Example 1, and the build-up speed of electrification was measured in the same manner as in Example 1. The results of the measurement of the build-up speed of electrification and the maximum charge amount are shown in Table 1.

EXAMPLE 4

Production of Carrier

To the same carrier-coating resin solution as in Example 3 was added carbon black (Vulcan XC-72, manufactured by Cabot Co., Ltd.; specific gravity, 1.2) as fine electroconductive particles in an amount of 15 vol % based on the amount of the resin. The resulting mixture containing the solvent was treated with a 1-liter sand mill for 1 hour at a rotational speed of 1,468 rpm to disperse the particles. Thus, a coating solution was obtained.

To 100 parts by weight of ferrite particles having a particle diameter of about 80 μm was added 1 part by weight of the coating solution. The ferrite particles were coated by kneading the mixture with a kneader to obtain a carrier. The coating layer thus obtained had a thickness of about 1 μm, and the carrier had a dynamic resistivity of $5\times10^5$ Ωcm. The work function of the surface of this carrier was measured in the same manner as in Example 1, and was found to be 4.6 eV. The work function of the copolymer alone was 4.4 eV, and that of the fine electroconductive particles was 5.10 eV.

Production of Toner

A toner was produced as follows. A mixture of 92 parts by weight of a binder resin consisting of a styrene/butyl acrylate copolymer and 8 parts by weight of carbon black BPL (manufactured by Cabot Co., Ltd.) as a colorant was kneaded with an extruder, pulverized with a jet mill, and then classified with an air classifier to obtain black toner particles having a $d_{50}$ of 9.5 μm.

Measurement of Build-up Speed of Electrification

A 37.5 g portion of the carrier was mixed with 2.25 g of the toner (corresponding to 6 parts by weight of the toner per 100 parts by weight of the carrier) in the same manner as in Example 1, and the build-up speed of electrification was measured in the same manner as in Example 1. The results of the measurement of the build-up speed of electrification and the maximum charge amount are shown in Table 1.

EXAMPLE 5

To 100 parts by weight of the toner produced in Example 1 was added 0.5 parts by weight of hydrophobic silica (R972, manufactured by Nippon Aerosil Co., Ltd.). The resulting mixture was treated with a high-speed mixer to obtain a toner containing the external additive.

A hundred parts by weight of the carrier produced in Example 3 was mixed with 5 parts by weight of the above toner by means of a ball mill in the same manner as in Example 1 to measure the build-up speed of electrification. The results of the measurement of the build-up speed of electrification and the maximum charge amount are shown in Table 1.

EXAMPLE 6

To 100 parts by weight of the toner produced in Example 3 were added 0.3 parts by weight of hydrophobic silica (R972, manufactured by Nippon Aerosil Co., Ltd.) and 0.3 parts by weight of titania (MT500B, manufactured by Teika Co., Ltd.). The resulting mixture was treated with a high-speed mixer to obtain a toner containing the external additives.

A hundred parts by weight of the carrier produced in Example 3 was mixed with 6 parts by weight of the above toner by means of a ball mill in the same manner as in Example 1 to measure the build-up speed of electrification. The results of the measurement of the build-up speed of electrification and the maximum charge amount are shown in Table 1.

EXAMPLE 7

To a 13 wt % toluene solution of a carrier-coating resin consisting of a blend of 90 parts of a copolymer of 90 parts by weight of styrene and methyl methacrylate monomers (monomer ratio 20:80) and 10 parts by weight of diethylaminoethyl methacrylate with 10 parts of perfluorooctylethyl methacrylate/methyl methacrylate copolymer (monomer ratio, 40/60 (by weight); LP-15, manufactured by Soken Kagaku Co., Ltd.) was added carbon black (Vulcan XC-72, manufactured by Cabot Co., Ltd.; specific gravity, 1.2) as fine electroconductive particles in an amount of 10 vol % based on the amount of the resin. The resulting mixture containing the solvent was treated with a 1-liter sand mill for 1 hour at a rotational speed of 1,468 rpm to disperse the particles. Thus, a coating solution was prepared.

To 100 parts by weight of ferrite particles having a particle diameter of about 50 μm was added 2 parts by weight of the coating solution. The ferrite particles were coated by kneading the mixture with a kneader to obtain a carrier. The coating layer thus obtained had a thickness of about 2 μm, and the carrier had a dynamic resistivity of $2\times10^8$ Ωcm. The work function of the surface of this carrier was measured in the same manner as in Example 1, and was found to be 4.55 eV. The work function of the copolymer of 90 parts by weight of styrene and methyl methacrylate monomers (monomer ratio 20:80) and 10 parts by weight of diethylaminoethyl methacrylate, as one of the components of the carrier-coating resin, was 4.35 eV, while the work function of the perfluorooctylethyl methacrylate/methyl methacrylate copolymer, as the other component, was 4.9 eV. The work function of the coating resin as a whole was 4.45 eV. Further, the work function of the fine electroconductive particles was 5.10 eV.

The toner produced in Example 1 was mixed with the above carrier under the same conditions as in Example 1 to measure the build-up speed of electrification. The results obtained are shown in Table 1 together with the maximum charge amount.

COMPARATIVE EXAMPLE 1

A carrier was obtained under the same conditions as in Example 1, except that a methyl methacrylate/styrene copolymer (monomer ratio, 70/30) was used as a carrier-coating resin in combination with Passtran Type IV (manufactured by Mitsui Mining & Smelting Co., Ltd.; $SnO_2$-coated $BASO_4$; specific gravity, 5.6) as fine electroconductive particles. The work function of the surface of this carrier was measured in the same manner as in Example 1, and was found to be 4.7 eV. The work function of the methyl methacrylate/styrene copolymer was 4.65 eV, and that of the fine electroconductive particles was 4.9 eV.

The toner produced in Example 1 was mixed with the above carrier under the same conditions as in Example 1 to measure the build-up speed of electrification. The results obtained are shown in Table 1 together with the maximum charge amount.

COMPARATIVE EXAMPLE 2

A carrier was obtained in the same manner as in Example 1, except that a methyl methacrylate/styrene copolymer (monomer ratio, 70/30) was used as a carrier-coating resin and carbon black (Vulcan XC-72, manufactured by Cabot Co., Ltd.) in an amount of 15 vol % based on the volume of the resin was used as fine electroconductive particles. The work function of the surface of this carrier was measured in the same manner as in Example 4, and was found to be 4.8 eV. The work function of the methyl methacrylate/styrene copolymer was 4.65 eV, and that of the fine electroconductive particles was 5.1 eV.

The toner produced in Example 1 was mixed with the above carrier under the same conditions as in Example 1 to measure the build-up speed of electrification. The results obtained are shown in Table 1 together with the maximum charge amount.

COMPARATIVE EXAMPLE 3

A hundred parts by weight of an uncoated ferrite carrier having a particle diameter of about 50 μm was mixed with 8 parts by weight of the same toner as in Example 1 in the same manner as in Example 1 to measure the build-up speed of electrification. The found values of the build-up speed of electrification and maximum charge amount are shown in Table 1. The work function of the uncoated carrier was 4.77 eV.

COMPARATIVE EXAMPLE 4

A hundred parts by weight of an uncoated ferrite carrier having a particle diameter of about 50 μm was mixed with 6 parts by weight of the same toner as in Example 3 in the same manner as in Example 1 to measure the build-up speed of electrification. The found values of the build-up speed of electrification and maximum charge amount are shown in Table 1. The work function of the uncoated carrier was 4.77 eV.

COMPARATIVE EXAMPLE 5

A hundred parts by weight of an uncoated ferrite carrier having a particle diameter of about 50 μm was mixed with 5 parts by weight of the toner produced in Example 5, which-contained silica as an external additive, in the same manner as in Example 5 to measure the build-up speed of electrification. The found values of the build-up speed of electrification and maximum charge amount are shown in Table 1. The work function of the uncoated carrier was 4.77 eV.

COMPARATIVE EXAMPLE 6

A hundred parts by weight of an uncoated ferrite carrier having a particle diameter of about 50 μm was mixed with 6 parts by weight of the toner produced in Example 6, which contained silica and titania as external additives, in the same manner as in Example 6 to measure the build-up speed of electrification. The found values of the build-up speed of electrification and maximum charge amount are shown in Table 1. The work function of the uncoated carrier was 4.77 eV.

COMPARATIVE EXAMPLE 7

A coated carrier having a coating layer thickness of about 1 μm was produced in the same manner as in Example 1, except that the fine electroconductive particles were omitted. This carrier had a dynamic resistivity of $6\times10^{12}$ Ωcm. The carrier was mixed with the same toner in the same manner as in Example 1 to measure the build-up speed of electrification. The found values of the build-up speed of electrification and maximum charge amount are shown in Table 1. The work function of the coated carrier was 4.4 eV.

TABLE 1

| | Work function (eV) | | | Dynamic resistivity of carrier (Ωcm) | Fine electroconductive particles in carrier | Resistivity of fine electroconductive particles (Ωcm) |
|---|---|---|---|---|---|---|
| | Coating resin | Carrier | Fine electroconductive particles | | | |
| Ex. 1 | 4.4 | 4.4 | 4.9 | $3\times10^{7}$ | $SnO_2$-coated $BaSO_4$ | $10^{0}$ |
| Ex. 2 | 4.45 | 4.4 | 4.86 | $8\times10^{8}$ | $SnO_2$-coated $BaSO_4$ | $10^{5}$ |
| Ex. 3 | 4.4 | 4.45 | 4.97 | $6\times10^{6}$ | $BaSO_4$ coated with Sb-doped $SnO_2$ | $10^{1}$ |
| Ex. 4 | 4.4 | 4.6 | 5.1 | $5\times10^{5}$ | carbon black | $10^{1}$ |
| Ex. 5 | 4.4 | 4.45 | 4.97 | $6\times10^{6}$ | $BaSO_4$ coated with Sb-doped $SnO_2$ | $10^{1}$ |
| Ex. 6 | 4.4 | 4.45 | 4.97 | $6\times10^{6}$ | $BaSO_4$ coated with Sb-doped $SnO_2$ | $10^{1}$ |
| Ex. 7 | 4.45 | 4.55 | 5.1 | $2\times10^{8}$ | carbon black | $10^{1}$ |
| Comp. Ex. 1 | 4.65 | 4.7 | 4.9 | $3\times10^{7}$ | $SnO_2$-coated $BaSO_4$ | $10^{5}$ |
| Comp. Ex. 2 | 4.65 | 4.8 | 5.1 | $5\times10^{5}$ | carbon black | $10^{1}$ |
| Comp. Ex. 3 | none | 4.77 | none | $1\times10^{10}$ | none | — |
| Comp. Ex. 4 | none | 4.77 | none | $1\times10^{10}$ | none | — |
| Comp. Ex. 5 | none | 4.77 | none | $1\times10^{10}$ | none | — |

TABLE 1-continued

| | | | | | | |
|---|---|---|---|---|---|---|
| Comp. Ex. 6 | none | 4.77 | none | $1 \times 10^{10}$ | none | — |
| Comp. Ex. 7 | 4.4 | 4.4 | none | $6 \times 10^{12}$ | none | — |

| | Average particle diameter of fine electroconductive particles (nm) | Content of fine electro-conductive particles (vol %) | External toner additive (pts.wt.) | Toner concen-tration (pts.wt.) | Build-up speed of electri-fication ($min^{-1}$) | Maximum charge amount (μC/g) |
|---|---|---|---|---|---|---|
| Ex. 1 | 100 | 20 | none | 8 | 0.22 | −26.5 |
| Ex. 2 | 100 | 20 | none | 8 | 0.10 | −28.6 |
| Ex. 3 | 100 | 30 | none | 6 | 0.74 | −21.4 |
| Ex. 4 | 16 | 15 | none | 6 | 0.48 | −15.3 |
| Ex. 5 | 100 | 30 | silica 0.5 | 5 | 1.8 | −29.8 |
| Ex. 6 | 100 | 30 | silica 0.3 titania 0.3 | 6 | 3.2 | −24.1 |
| Ex. 7 | 16 | 10 | none | 8 | 0.15 | −20.2 |
| Comp. Ex. 1 | 100 | 20 | none | 8 | $2.1 \times 10^{-3}$ | −20.3 |
| Comp. Ex. 2 | 16 | 15 | none | 8 | $2.8 \times 10^{-3}$ | −18.1 |
| Comp. Ex. 3 | — | 0 | none | 8 | $1.2 \times 10^{-3}$ | −22.5 |
| Comp. Ex. 4 | — | 0 | none | 6 | $1.9 \times 10^{-3}$ | −27.8 |
| Comp. Ex. 5 | — | 0 | silica 0.5 | 5 | $2.3 \times 10^{-2}$ | −29.3 |
| Comp. Ex. 6 | — | 0 | silica 0.3 titania 0.3 | 6 | $4.6 \times 10^{-2}$ | −26.7 |
| Comp. Ex. 7 | — | 0 | none | 8 | 0.47 | −44.5 |

Results of Experiments

The results show that the build-up speeds of electrification for developers containing a carrier having a work function of more than 4.6 eV were lower by at least one order of magnitude than those of developers comprising the same toner and another carrier. The results further show that since coating with a resin having a work function of 4.5 eV or lower and containing no fine electroconductive particles resulted in too large charge amounts, incorporation of fine electroconductive particles into the coating layer was necessary for keeping the amount of charges within an appropriate range, and that the incorporation of those particles was effective also in heightening the build-up speed of electrification.

EXAMPLE 8

A hundred parts by weight of the carrier shown in Example 4 was mixed with 5 parts by weight of the toner containing external additives as shown in Example 6 to obtain a developer. This developer was subjected to a copying test using a modified copier (the peripheral-speed ratio of the developing roll to the photoreceptor in the with mode was 1.0) of electrophotographic copier A-Color 630 (manufactured by Fuji Xerox Co., Ltd.). This developer showed a satisfactory electrification speed although that peripheral-speed ratio was 1.0, causing neither a decrease in charge amount nor toner dusting. Further, satisfactory images having an image density measured by X-Rite 404 (manufactured by X-Rite Co., Ltd.) of 1.2 or higher were obtained.

This developer was further subjected to a 50,000-sheet copying test in a moderate temperature and a moderate humidity (22° C., 55% RH) atmosphere. As a result, the developer generally gave stable images which suffered neither fluctuations of image density nor background fouling. The amount of charges was measured at the beginning of copying and after 50,000-sheet copying and, as a result, the ratio of the charge amount after 50,000-sheet copying to the initial charge amount was found to be 0.85. For the purpose of comparison, the same experiment was conducted using a modified copier of electrophotographic copier A-Color 630 (manufactured by Fuji Xerox Co., Ltd., peripheral-speed ratio of the developing roll to the photoreceptor in the with mode was 2.5). As a result, the ratio of the charge amount after 50,000-sheet copying to the initial charge amount was 0.5, showing that the amount of charges had decrease considerably. Further, the copies obtained had suffered background fouling and fogging.

According to the present invention, by employing the constitution described above, it has become possible to obtain a developer in which the toner particles can be quickly charged to a proper electrification level even when the toner contains no charge control agents or contains a reduced amount of an external additive. As a result, the fouling of the carrier surface by a charge control agent or external additive can be inhibited, and it has become possible to obtain copied images of stable quality over long.

While the invention has been described in detail and with reference to specific embodiments thereof, it will be apparent to one skilled in the art that various changes and modifications can be made therein without departing from the spirit and scope thereof.

What is claimed is:

1. A carrier for an electrostatic latent-image developer, which comprises a core material having thereon a coating layer comprising a resin and fine electroconductive particles, wherein the resin has a work function of 4.5 eV or lower.

2. The carrier for an electrostatic latent-image developer as claimed in claim 1, wherein the resin comprises at least one member selected from the group consisting of poly (vinyl alcohol), poly(ethylene glycol), graft copolymers of diethylaminoethyl methacrylate and styrene-acrylic, and graft copolymers of diethylaminoethyl methacrylate and methyl methacrylate.

3. The carrier for an electrostatic latent-image developer as claimed in claim 1, wherein the coating layer of the carrier has a work function of 4.6 eV or lower.

4. The carrier for an electrostatic latent-image developer as claimed in claim 1, wherein the fine electroconductive particles have a work function of from 4.6 to 5.2 eV.

5. The carrier for an electrostatic latent-image developer as claimed in claim 1, wherein the fine electroconductive particles have a resistivity of $10^5$ Ωcm or lower.

6. The carrier for an electrostatic latent-image developer as claimed in claim 1, wherein the coating layer contains the fine electroconductive particles in an amount of from 2 to 40% by volume based on the volume of the coating layer.

7. The carrier for an electrostatic latent-image developer as claimed in claim 1, wherein the fine electroconductive particles have an average particle diameter of from 10 to 500 nm.

8. The carrier for an electrostatic latent-image developer as claimed in claim 1, wherein the resin contains a fluororesin or a silicone resin.

9. The carrier for an electrostatic latent-image developer as claimed in claim 8, wherein the content of the fluororesin or the silicone resin in the resin constituting the coating layer is from 2 to 20% by weight based on the weight of the coating layer.

10. The carrier for an electrostatic latent-image developer as claimed in claim 1, which has a dynamic resistivity in a $10^4$ V/cm electric field of $10^9$ Ωcm or lower.

11. An electrostatic latent-image developer which comprises a carrier for an electrostatic latent-image developer and a toner comprising a binder resin and a colorant, wherein the carrier comprises a core material having thereon a coating layer comprising a resin and fine electroconductive particles, the resin having a work function of 4.5 eV or lower.

12. The electrostatic latent-image developer as claimed in claim 11, wherein the binder resin of the toner comprises a styrene/acrylic resin, a polyester resin, or an epoxy resin.

13. The electrostatic latent-image developer as claimed in claim 12, wherein the toner contains silica and/or titania as an external additive.

14. An image forming process comprising:

forming a latent image on a latent-image holder;

developing the latent image with a developer to form a toner image;

transferring the toner image to a receiving material; and fixing the toner image to the receiving material, wherein the developer is an electrostatic latent image developer which comprises a carrier for an electrostatic latent-image developer and a toner comprising a binder resin and a colorant, wherein the carrier comprises a core material having thereon a coating layer comprising a resin and fine electroconductive particles, the resin having a work function of 4.5 eV or lower.

* * * * *